US005322040A

United States Patent [19]

Lo

[11] Patent Number: 5,322,040

[45] Date of Patent: Jun. 21, 1994

[54] MODEL ENGINE STARTER

[76] Inventor: Michael Lo, No. 14, Ching Nan Hsiang, Chuan Ching Li, Taichung, Taiwan

[21] Appl. No.: 2,959

[22] Filed: Jan. 11, 1993

[51] Int. Cl.[5] ..... F02N 5/02

[52] U.S. Cl. ..... 123/185.14; 123/185.3; 123/DIG. 3

[58] Field of Search ..... 123/185.14, 185.2, 185.3, 123/DIG. 3, 185.7; 74/7 C; 192/42

[56] References Cited

U.S. PATENT DOCUMENTS 2,800,744 7/1957 Boultinghouse ..... 123/DIG. 3

*Primary Examiner*—Andrew M. Dolinar

*Attorney, Agent, or Firm*—Bacon & Thomas

[57] ABSTRACT

Disclosed is a model engine starter including a T-shaped starterator having sloping edges on its head coupled to the crank and piston link of a model engine by a spring supported coupling pin, wherein turning the T-shaped starterator by a traction rope through a spiral power spring and flywheel causes the model engine to start working; the turning of the crank by the model engine causes the coupling pin to pass over the sloping edges without causing the T-shaped starterator to rotate.

1 Claim, 2 Drawing Sheets

MODEL ENGINE STARTER

BACKGROUND OF THE INVENTION

The present invention relates to a model engine starter for causing the engine of a toy model to start working, which minimizes transmission loss of the engine.

A variety of toy models, from the earlier plastic molded models to the recent engine-operated iron alloy models, are known and widely accepted by people of all ages. The engine determines the performance of an engine-operated model. Therefore, the engine of an engine-operated model should be made lightweight and efficient. In turning the engine of an engine-operated model, an engine starter should be used. FIG. 1 illustrates the arrangement of a prior art engine starter in an engine-operated model, which comprises a hollow swivel block, a T-shaped starterator, an one-way bearing and a turning mechanism. The T-shaped starterator is coupled to the hollow swivel block and inserted in a tube of the turning mechanism supported on the one-way bearing. The hollow swivel block has an eccentric hole, which receives a coupling pin. The coupling pin has an opposite end connected to the transmission shaft of the model engine through a crank. The tube of the turning mechanism is coupled with a flywheel driven by a traction rope and a spiral power spring. Turning the T-shaped starterator by the traction rope through the spiral power spring and the flywheel causes the model engine to start working. Because the coupling pin is received in the eccentric hole on the hollow swivel block, the engine starter is synchronously rotated by the crank and the piston link as the model engine started, and therefore part of the engine power is wasted by the engine starter.

SUMMARY OF THE INVENTION

An object of the present invention is to eliminate the aforesaid problem. Another object of the present invention is to provide a model engine starter which is easy to install. According to the preferred embodiment of the present invention, a model engine starter is comprised of a T-shaped starterator supported on a supporting block and having its end coupled with a flywheel driven by a traction rope through a spiral power spring and its head formed into three sloping edges and coupled to the crank and piston link of the model engine by a spring supported coupling pin. Therefore, turning the T-shaped starterator by the traction rope through spiral power spring causes the crank and the piston link to start the model engine. As the model engine was started, the synchronizing motion of the crank and the piston link causes the spring supported coupling pin to pass over the sloping edges without causing the T-shaped starterator to rotate. Therefore, the engine power of the model engine is completely transmitted through a transmission mechanism to move the toy model.

DETAILED DESCRIPTION OF THE PRESENT INVENTION

Figure 1:
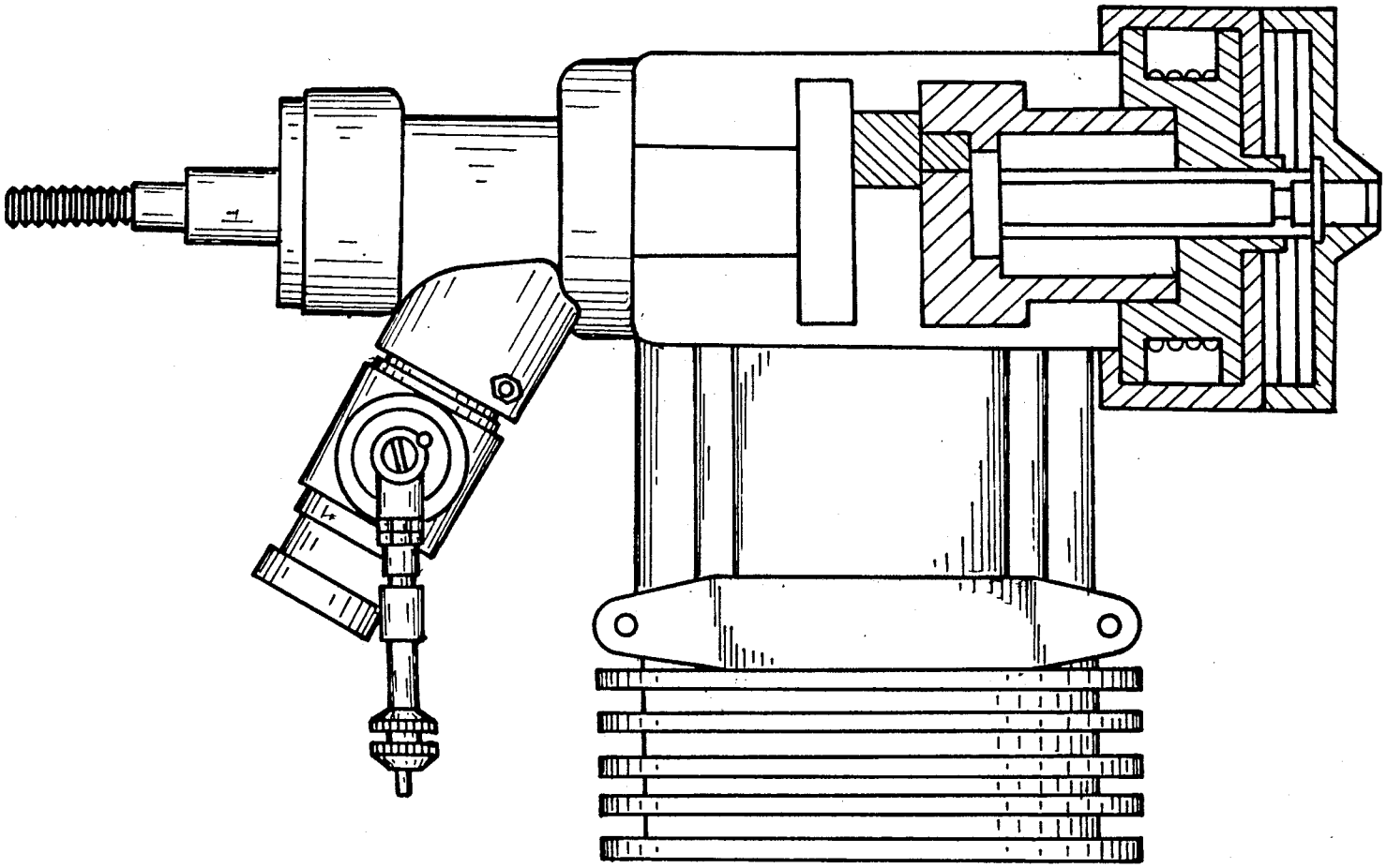
Fig. 1 PRIOR ART
FIG. 1 illustrates the structure of a model engine starter according to the prior art.
Figure 2:
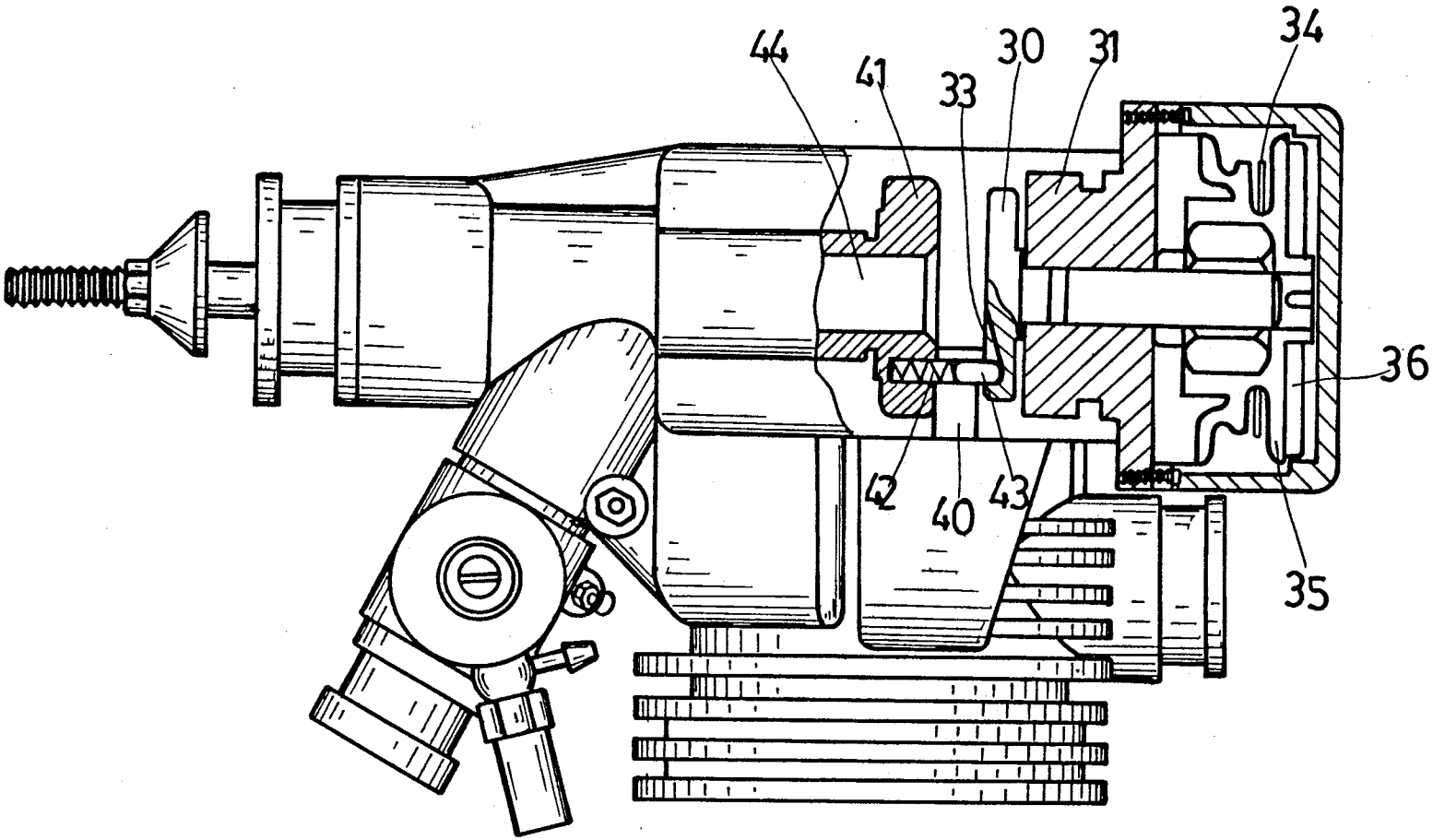
FIG. 2 illustrates the structure of a model engine starter according to the present invention.

Referring to FIG. 2, a model engine starter in accordance with the present invention comprises a T-shaped starterator 30, a supporting block 31, and a turning mechanism. The T-shaped starterator 30 has a connecting surface, which connects the crank 41 of the model engine through a piston link 40, formed into three radial sloping edges 33 sloping in the same direction. The coupling pin 43 which couples the piston link 40 and the crank 41 to the T-shaped starterator 30 is supported on a compression spring 42 and stopped at either sloping edge 33. The turning mechanism comprises a spiral power spring 36 driven by a traction rope 34 through a flywheel 35. Pulling the traction rope 34 causes the flywheel 35 to stretch the spiral power spring 36, and the T-shaped starterator 30, piston link 40 and crank 41 are simultaneously turned in the reverse direction. Releasing the traction rope 34 causes quick return of the spiral power spring 36, and therefore the T-shaped starterator 30 is driven to turn the crank 41 and the piston link 40 in starting the model engine. Because the coupling pin 43 is supported on the compression spring 42 and stopped at either sloping edge 33, the forward rotation of the transmission mechanism 44 of the model engine causes the coupling pin 43 to pass over the sloping grooves 33 round and round without causing the T-shaped starterator 30 to rotate. Therefore, transmission loss of the transmission mechanism 44 is minimized.

I claim:

1. A model engine starter comprising a T-shaped starterator having its head coupled to the piston link and crank of a model engine by a coupling pin and its end coupled with a flywheel driven by traction rope through a spiral power spring to cause start of the model engine, wherein the head of said T-shaped starterator has a connecting surface formed into three radial sloping edges sloping in the same direction for connecting said crank to the starterator through said coupling pin; said coupling pin has one end supported on a spring in a hole on said crank and an opposite end inserted through a hole on said crank and an opposite end inserted through a hole on said piston link and stopped at one of the sloping edges on said T-shaped starterator, whereby turning of said crank by said model engine causes said coupling pin to pass over and around said sloping grooves without causing said T-shaped starterator to rotate.

* * * * *